US010539017B2

(12) United States Patent
Lenaburg

(10) Patent No.: US 10,539,017 B2
(45) Date of Patent: Jan. 21, 2020

(54) CUTTER HOUSING WITH FIELD-REPLACEABLE SEATS

(71) Applicant: The Robbins Company, Solon, OH (US)

(72) Inventor: Carl E. Lenaburg, Tacoma, WA (US)

(73) Assignee: The Robbins Company, Solon, OH (US)

( * ) Notice: Subject to any disclaimer, the term of this patent is extended or adjusted under 35 U.S.C. 154(b) by 0 days.

(21) Appl. No.: 15/917,026

(22) Filed: Mar. 9, 2018

(65) Prior Publication Data

US 2018/0258764 A1 Sep. 13, 2018

Related U.S. Application Data

(60) Provisional application No. 62/470,176, filed on Mar. 10, 2017.

(51) Int. Cl.
*E21D 9/10* (2006.01)

(52) U.S. Cl.
CPC ..... *E21D 9/104* (2013.01)

(58) Field of Classification Search
CPC ..... E21D 9/104; E21D 9/11; E21D 9/112; E21D 9/111; E21D 9/118; E21D 9/113; E21D 9/115; E21D 9/116; E21D 9/117
See application file for complete search history.

(56) References Cited

U.S. PATENT DOCUMENTS 2,550,202 A 4/1951 Robbins
2,811,341 A 10/1957 Robbins
3,612,196 A * 10/1971 Dixon ..... E21B 10/10 175/364
3,835,944 A * 9/1974 Bingham ..... E21B 10/10 175/347
4,202,418 A 5/1980 Waddell
4,270,618 A 6/1981 Owens
RE31,511 E 1/1984 Spencer
4,548,443 A 10/1985 Turner
(Continued)

FOREIGN PATENT DOCUMENTS

AT 13486 U1 1/2014
CA 2785364 A1 6/2011
(Continued)

*Primary Examiner* — David J Bagnell
*Assistant Examiner* — Michael A Goodwin
(74) *Attorney, Agent, or Firm* — Christensen O'Connor Johnson Kindness, PLLC

(57) ABSTRACT

A housing mount assembly for a TBM disc cutter assembly having a shaft and cutter wheel assembly includes a housing half with a body and opposite edge portions extending away from the body. A removable seat block is fixed to the housing half in a space between the edge portions, and is configured to transmit forces received from the cutter shaft to the housing half in shear. A first face of the seat block is pressed against a face of one of the edge portions, and second face is pressed against the housing half body. The seat block may be preloaded against the housing half with first and second pluralities of bolts arranged perpendicularly. The seat block is configured to be removable in the field without removing the housing half from the TBM. The seat block may be hardened to a Rockwell C hardness in the range of Rc 58 to 60.

21 Claims, 5 Drawing Sheets

(56) References Cited

U.S. PATENT DOCUMENTS

| | | | |
|---|---|---|---|
| 5,205,613 | A | 4/1993 | Brown, Jr. |
| 5,308,151 | A | 5/1994 | Sugden et al. |
| 5,421,422 | A | 6/1995 | Crane et al. |
| 5,598,895 | A | 2/1997 | Anderson et al. |
| 6,142,577 | A | 11/2000 | Tayama et al. |
| 8,172,334 | B2 | 5/2012 | Lindbergh et al. |
| 9,845,677 | B2 | 12/2017 | Lenaburg et al. |
| 2009/0297273 | A1 | 12/2009 | Lindbergh et al. |
| 2013/0045055 | A1 | 2/2013 | Derycke et al. |
| 2013/0341998 | A1 | 12/2013 | Lenaburg |
| 2014/0232167 | A1 | 8/2014 | Edelmann et al. |

FOREIGN PATENT DOCUMENTS

| | | | | | |
|---|---|---|---|---|---|
| CN | 202055831 | U | * | 11/2011 | ..... E21D 9/08 |
| CN | 106285707 | A | * | 1/2017 | ..... E21D 9/08 |
| DE | 102011114830 | B3 | | 3/2013 | |
| JP | 10-68292 | A | | 3/1998 | |
| JP | 10-68293 | A | | 3/1998 | |
| JP | 11-217993 | A | | 7/1999 | |
| JP | 2000-17981 | A | | 1/2000 | |
| JP | 2007-070825 | A | | 3/2007 | |
| JP | 2013-127182 | A | | 6/2013 | |
| WO | 2015/063322 | A2 | | 5/2015 | |

* cited by examiner

CUTTER HOUSING WITH FIELD-REPLACEABLE SEATS

CROSS-REFERENCE TO RELATED APPLICATION

This application claims the benefit of U.S. Provisional Application No. 62/470,176, filed Mar. 10, 2017, the disclosure of which is hereby incorporated by reference in its entirety.

BACKGROUND

A tunnel boring machine ("TBM") is a tunnel excavation apparatus for forming tunnels in a variety of soil and rock strata. A conventional TBM produces a smooth circular tunnel wall, with minimal collateral disturbance. As discussed in U.S. Pat. No. 8,172,334, to Lindbergh et al., which is hereby incorporated by reference in its entirety, a conventional TBM includes a rotatably driven cutterhead that supports a plurality of disc cutter assemblies. Typically, a cutterhead may have 20, 50, 100, or more disc cutter assemblies rotatably mounted to the cutterhead. The disc cutter assemblies are removable from the cutterhead so that the disc cutter assemblies may be replaced or maintained.

A breakthrough that made TBMs efficient and reliable was the introduction of the disc cutter assembly by James S. Robbins in the 1950s. Initially, Robbins' TBM used rigid spikes rotating in a circular motion, but the spikes would frequently break. See, for example, U.S. Pat. No. 2,811,341, to Robbins. Robbins found that rotatable disc cutter assemblies provided greater reliability in the field. See, for example, U.S. Pat. No. 2,550,202, to Robbins. It is believed that virtually all modern TBMs use rotatable disc cutter assemblies.

In operation, the TBM cutterhead is urged against a surface, for example a tunnel face, such that at least some of the disc cutter assemblies engage the tunnel face. For example, in some TBMs a plurality of hydraulic cylinders are configured to engage the tunnel walls aft of the cutterhead to anchor the TBM, and separate thrust cylinders press the rotating cutterhead against the tunnel face. The cutterhead rotates about a longitudinal axis such that the disc cutter assemblies roll along the face to fracture, loosen, grind, dislodge, and/or break materials from the tunnel face. The fractured and loosened material is collected and removed to gradually form the tunnel.

The disc cutter assemblies are typically removably retained between a pair of oppositely disposed housing halves (sometimes referred to as a housing assembly) that are fixedly attached to corresponding mounting plates on a TBM cutterhead assembly. The disc cutter assemblies are mounted such that the outer cutter ring extends from the face of the TBM cutterhead assembly to engage the tunnel face. Another illustrative tunnel boring machine is disclosed in U.S. Pat. No. 4,548,443, to Turner, and a main frame for a TBM is disclosed in U.S. Pat. No. RE 31511, to Spencer, which is hereby incorporated by reference.

In the partially exploded view in FIG. 1 a prior art disc cutter assembly 10 is shown between oppositely disposed mounting plates 19L, 19R that are typically permanently fixed to the TBM cutter wheel (not shown). Each mounting plate 19L, 19R supports a corresponding housing mount, also referred to as a housing half 20L, 20R. For example, the housing half 20L, 20R may be welded to the corresponding mounting plate 19L, 19R. In some embodiments the mounting plates 19L, 19R for all of the disc cutter assemblies 10 are permanently fixed to the cutter wheel, and a heat treatment is then applied to the cutter wheel assembly prior to attaching the housing halves 20L, 20R to the mounting plates 19L, 19R.

The disc cutter assembly 10 is mounted to the housing halves 20L, 20R, and includes an outer cutter ring 15 supported on a hub 12. The cutter ring 15 is positioned to engage the tunnel face during tunnel boring operations. Bearing assemblies (not shown) are provided between the shaft 13 and the hub 12 to provide for rotation of the hub 12 and cutter ring 15 about the shaft 13.

The housing halves 20L, 20R each define an L-shaped channel 21 having a long leg 21A and a short leg 21B. The L-shaped channel 21 is sized to slidably receive a shaped end of the cutter assembly shaft 13. The disc cutter assembly 10 is installed by inserting opposite ends of the shaft 13 into the long leg 21A of the channels 21 at the back of the housing mounts 20L, 20R. The disc cutter assembly 10 is slid along the long legs 21A of the L-shaped channel 21 and shifted laterally into the recess formed by the shorter legs 21B. The ends of the shaft 13 are secured to the housing halves 20L, 20R with wedge lock assemblies 22A that engage respective ends of the shaft 13.

The wedge lock assemblies 22A each include a wedge 22, a clamp block 24, and an optional tubular sleeve 28 disposed therebetween. The wedge 22 includes an angled face 22D that slidably engages an angled face 13D on the shaft 13, such that tightening the bolt 23 urges the shaft 13 end into the short leg 21B and against a seating surface of the housing half 20L, 20R. The clamp block 24 engages abutment surfaces 25 on the back end of the associated housing half 20L, 20R. The bolt 23 extends through the wedge 22, the sleeve 28, and the clamp block 24, and is secured with two nuts 26 and a washer 27. As the bolt 23 is tensioned by torqueing the nuts 26 to a design specification, the wedge 22 locks the cutter assembly 10 in place. The ends of the shaft 13 seat against faces 21C in the short legs 21B of the channel 21. It will be appreciated that the faces 21C (an in particular the face 21C facing downward in FIG. 1) must react the large and unsteady forces generated as the disc cutter assembly 10 cuts into the tunnel face.

The disc cutter assemblies 10 are subjected to very high forces during tunnel boring operations. Once excavation of the tunnel is started, it is difficult and time-consuming to repair or replace the disc cutter assemblies 10 because the assemblies are difficult to access in situ, and the cutter assemblies are heavy, often weighing many hundreds of pounds. Tunnels are often at significant depths, with correspondingly high ambient pressures. Therefore, it is critical that the installation of the cutter assembly in the cutterhead be very secure and reliable, even under the extreme conditions associated with tunnel boring.

In particular, the housing halves 20L, 20R are typically welded onto the mounting plates 19L, 19R, and are therefore challenging to remove and replace if they become damaged. If a housing half 20L, 20R becomes damaged during use, it typically must be replaced in situ, which is difficult and may shut down the TBM for an extended period of time.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A disc cutter and mounting assembly for a tunnel boring machine includes a disc cutter assembly and first and second housing mount assemblies. The disc cutter assembly includes a shaft with first and second end portions, and a cutter wheel rotatable on the shaft. The end portions of the shaft each define first, second, and third seat surfaces. The first and second housing mount assemblies each include a housing half having a body portion, a first edge portion extending away from the body portion, and a second edge portion extending away from the body portion. The body portion, the first edge portion, and the second edge portion cooperatively define a mounting space between the first and second edge portions. A removable seat block is disposed in the mounting space and is removably attached to the housing half such that a first face of the removable seat block is pressed against the first edge portion of the housing half, a second face of the removable seat block is pressed against the body portion of the housing half, and a seating face of the removable seat block engages the second flat seat surface of the associated end portion of the shaft. A wedge lock assembly includes a clamp block, a wedge member having a first face that slidably engage the housing half second edge portion and an opposite face that slidably engage the second seat surface of the associated end portion of the shaft. An elongate connector connects the clamp block to the wedge member and controllably adjusts a distance between the clamp block and the wedge member. The wedge lock assembly clamps the associated end portion of the shaft between the wedge member and the first edge portion of the housing half.

In an embodiment the removable seat blocks are removable from the assembly without removing the associated housing half from the tunnel boring machine.

In an embodiment the removable seat blocks receive tunnel boring forces from the shaft, and transmit the received forces to the associated housing half in shear.

In an embodiment the first face of the removable seat blocks are pressed against the first edge portion of the associated housing half with at least six bolts that extend through first apertures in the removable seat block and engage the first edge portion of the housing half.

In an embodiment the second face of the removable seat blocks are pressed against the body portion of the associated housing half with at least six bolts that extend through second apertures in the removable seat block and engage the body portion of the associated housing half.

In an embodiment the housing mount assemblies further comprise a preload bolt that extends through a longitudinal aperture in the removable seat block and engage an associated end portion of the shaft, wherein the preload bolts are configured to pull the associated end portion of the shaft against the removable seat block.

In an embodiment each of the removable seat blocks is disposed in a recess in the body portion of the associated housing half.

In an embodiment each of the removable seat blocks is in an interference fit with the recess in the associated housing half.

In an embodiment, for each of the first and second end portions of the shaft, the first seat surface is configured to abut the first edge portion of the associated housing half, the second seat surface is configured to abut the seating face of the removable seat block, and the third seat surface configured to abut the wedge member.

In an embodiment the seating face of the removable seat blocks is case hardened to a Rockwell C hardness in the range of Rc 58 to Rc 60.

In an embodiment the seating face of the removable seat block is convex.

A housing mount assembly for mounting a disc cutter assembly to a tunnel boring machine, wherein the disc cutter assembly includes a shaft having first and second end portions, each end portion having a first flat seat surface, a second flat seat surface, and a third flat seat surface, the housing mount assemblies includes a housing half comprising a body portion, a first edge portion extending away from the body portion, and a second edge portion extending away from the body portion, wherein the body portion, the first edge portion, and the second edge portion cooperatively define a mounting space between the first and second edge portions. A removable seat block disposed in the mounting space and removably attached to the housing half such that a first face of the removable seat block is pressed against the first edge portion of the housing half, a second face of the removable seat block is pressed against the body portion of the housing half, and a seating face of the removable seat block is configured to engage the second flat seat surface of the associated end portion of the shaft. A wedge lock assembly comprising a clamp block, a wedge member having a first face configured to slidably engage the housing half second edge portion and an opposite face configured to slidably engage the second flat seat surface of the associated end portion of the shaft, and an elongate connector adjustably connecting the clamp block to the wedge member and configured to controllably adjust a distance between the clamp block and the wedge member, whereby the wedge lock assembly is configured to clamp the associated end portion of the shaft between the wedge member and the first edge portion of the housing half.

In an embodiment the removable seat block is configured to be removable from the assembly without removing the associated housing half from the tunnel boring machine.

In an embodiment the removable seat block is configured to receive tunnel boring forces from the shaft, and to transmit the received forces to the housing half in shear.

In an embodiment the first face of the removable seat block is pressed against the first edge portion of the housing half with a first plurality of bolts comprising at least six bolts that extend through first apertures in the removable seat block and engage the first edge portion of the housing half.

In an embodiment the second face of the removable seat block is pressed against the body portion of the housing half with a second plurality of bolts comprising at least six bolts that extend through second apertures in the removable seat block and engage the body portion of the housing half.

In an embodiment the first plurality of bolts are oriented perpendicular to the second plurality of bolts.

In an embodiment the housing mount assembly includes a preload bolt that extends through a longitudinal aperture in the removable seat block and threadably engages the first end portion of the shaft, wherein the preload bolt is configured to press the end portion of the shaft against the removable seat block.

In an embodiment the removable seat block is disposed in a recess in the body portion of the housing half.

In an embodiment a seat portion of the removable seat block is case hardened to a Rockwell C hardness in the range of Rc 58 to Rc 60.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
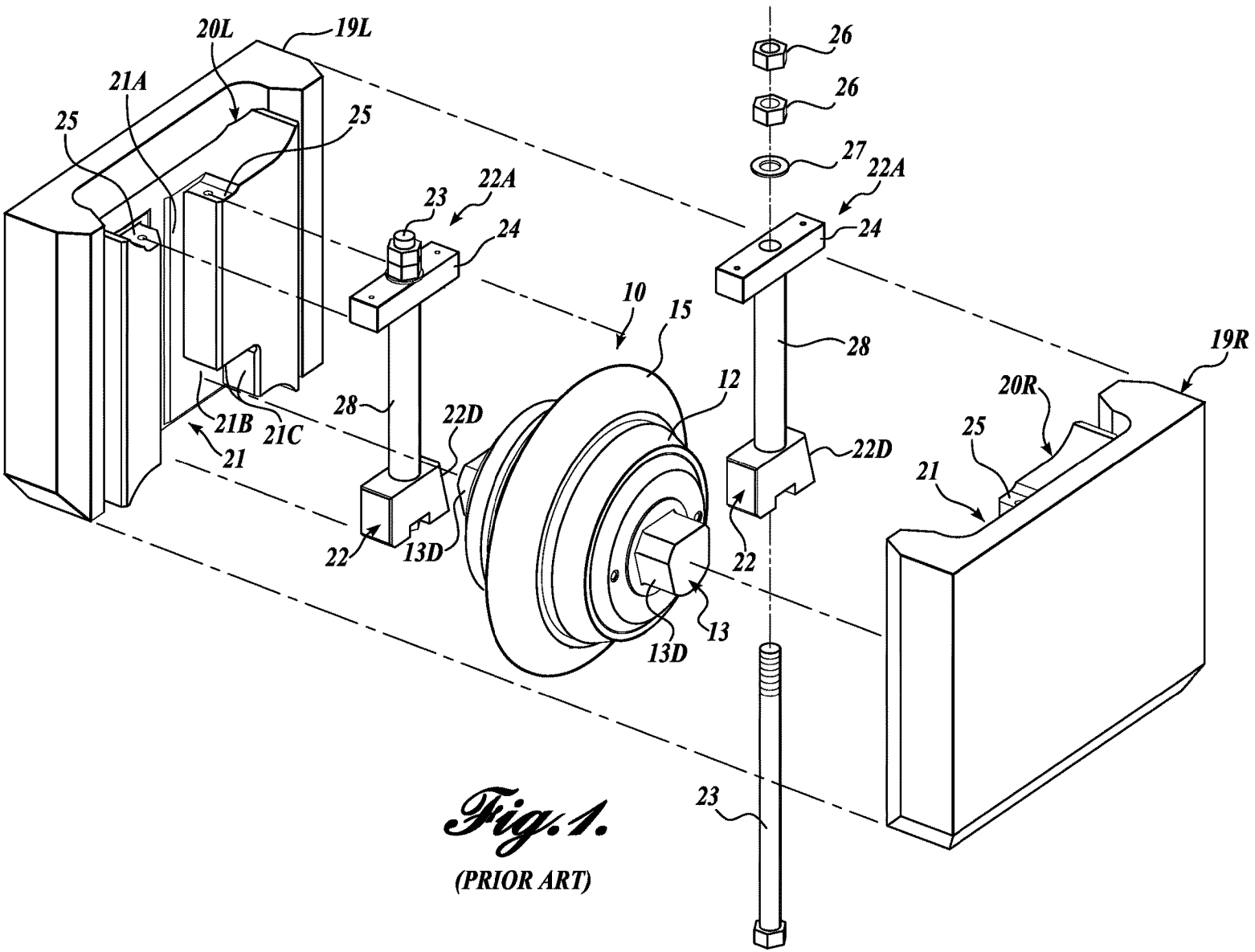
Fig. 1. (PRIOR ART)
FIG. 1 is a perspective, partially exploded view of a prior art cutter assembly and housing system.
Figure 2:
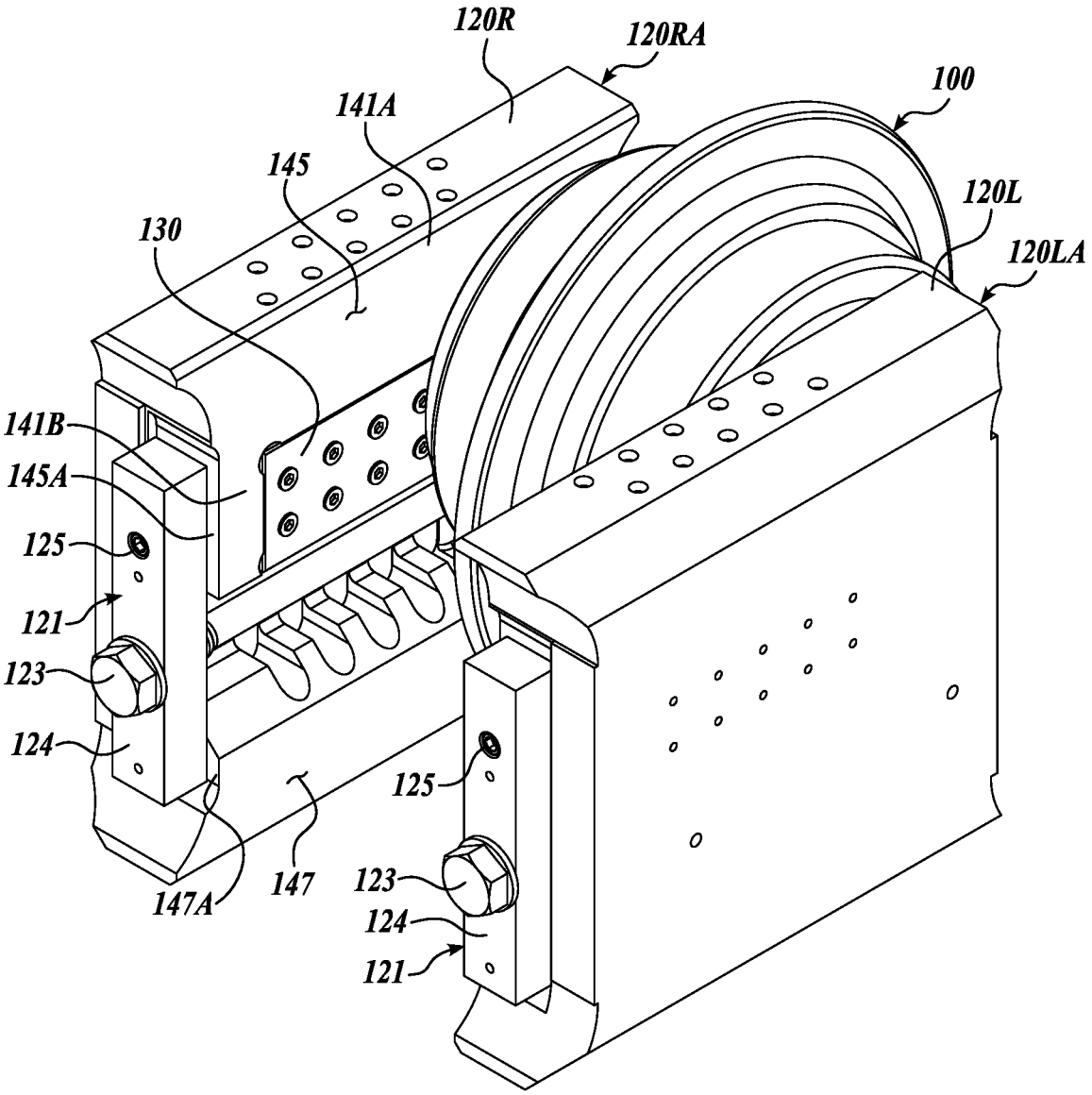
FIG. 2 is a perspective view of an embodiment of a disc cutter assembly installed in left and right housing halves that include removable seat blocks in accordance with the present invention.

FIG. 2 is a perspective view of a disc cutter assembly 100 mounted between a first housing mount assembly 120RA having a first housing half 120R, and a second housing mount assembly 120LA having a second housing half 120L. The second housing mount assembly 120LA is substantially identical (in mirror image) to the first housing mount assembly 120RA. Therefore, for clarity only the first housing mount assembly 120RA is described in detail. Typically the housing halves 120L, 120R are semi-permanently fixed to corresponding mounting plates (not shown) on a tunnel boring machine ("TBM"), for example, by welding the housing halves 120R, 120L to the corresponding mounting plates.

Figure 3:
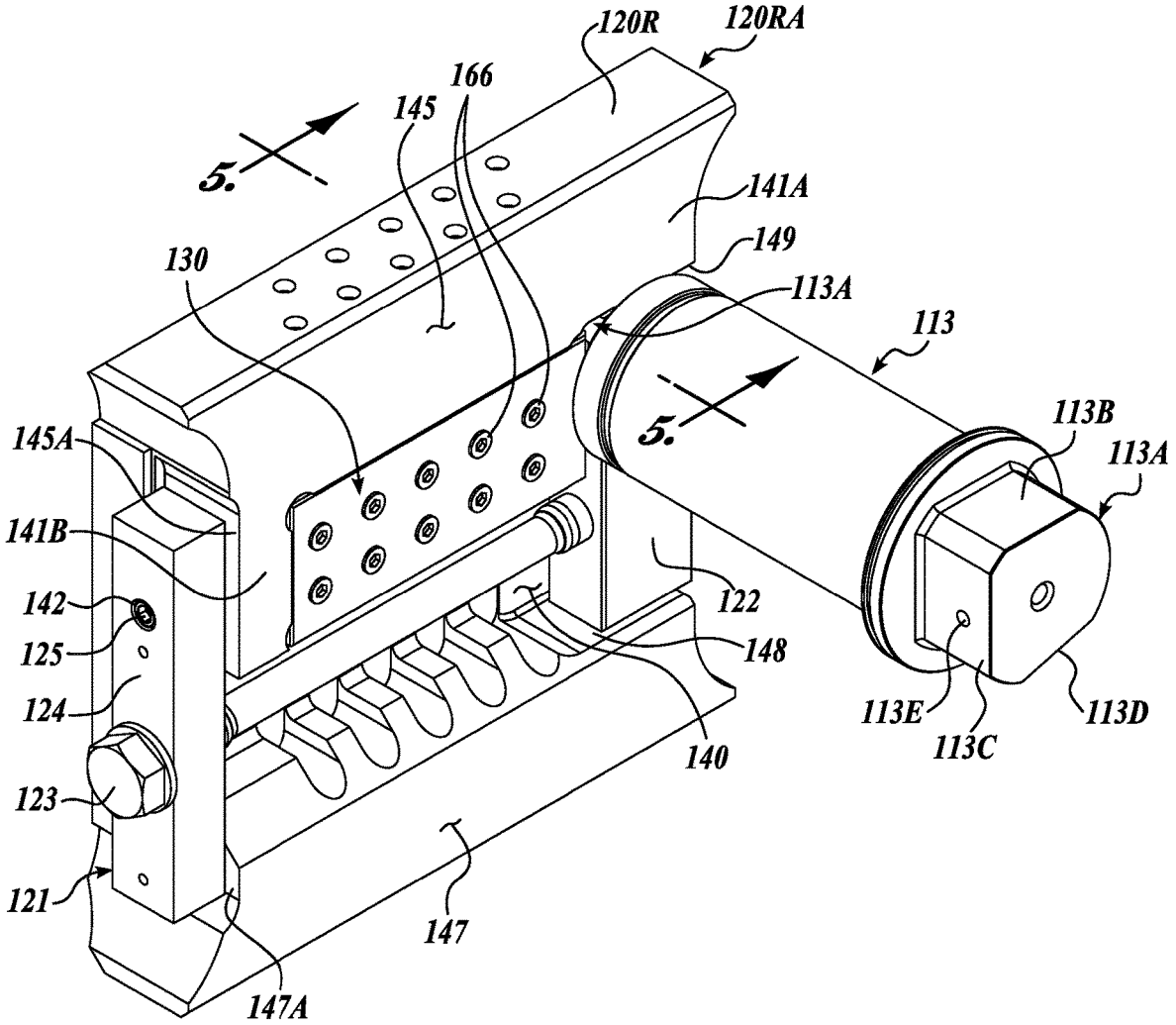
FIG. 3 is a perspective view of the right mounting half shown in FIG. 2 with the disc cutter shaft installed and portions of the disc cutter assembly omitted to reveal other features.

Refer also to FIG. 3 showing the first housing mount assembly 120RA with a shaft 113 of the disc cutter assembly 100 installed. Other portions of the disc cutter assembly 100 are omitted to expose features of the housing mount assembly 120RA. The shaft 113 has opposite end portions 113A that are shaped to be securely captured by the first and second housing mount assemblies 120LA, 120RA. Only one end portion 113A of the shaft 113 is visible in FIG. 3. The other shaft end portion is similar in mirror symmetry. It will be appreciated by persons of skill in the art that the connections of the shaft end portions 113A to the housing mount assemblies 120LA and 120RA are important because the extreme and unsteady forces exerted on the disc cutter assembly 100 during tunneling operations are transmitted through the connection of the end portions 113A to the housing mount assemblies 120LA, 120RA.

The housing mount assembly 120RA includes the housing half 120R comprising a main body portion 140, an L-shaped first edge portion 145 extending from one side of the main body portion 140, and a second edge portion 147 extending from an opposite side of the main body portion 140. A mounting space is defined between the first and second edge portions 145, 147. The first edge portion 145 has a first leg 141A that is generally parallel with the second edge portion 147, and an inwardly extending second leg 141B that extends towards the second edge portion 147. The second leg 141B defines a first abutment surface 145A. A second abutment surface 147A is defined by the second edge portion 147.

The shaft end portions 113A includes: (i) a first seat surface 113B positioned to seat against a corresponding seat surface 149 near an end of the first edge portion 145, (ii) a second seat surface 113C that is oriented to abut and seat against a corresponding surface of a removable seat block 130 (described below), and (iii) a third seat surface 113D that is oriented to abut and seat against a corresponding surface of a wedge member 122 on one end of a wedge lock assembly 121. The second seat surface 113C in this embodiment includes a threaded aperture 113E.

The wedge lock assembly 121 includes a connecting member, for example, a bolt 123 that extends through a clamp block 124 and engages the wedge member 122. The clamp block 124 is configured to abut the first and second abutment surfaces 145A and 147A and to adjustably engage the wedge member 122. For example, the bolt 123 may threadably engage the wedge member 122 such that the longitudinal position of the wedge member 122 between the third seat surface 113D and the corresponding seat surface 148 of the second edge portion 147 may be slidably adjusted to produce a clamping force on the shaft end portion 113A between the wedge member 122 and first edge portion 145.

Figure 4:
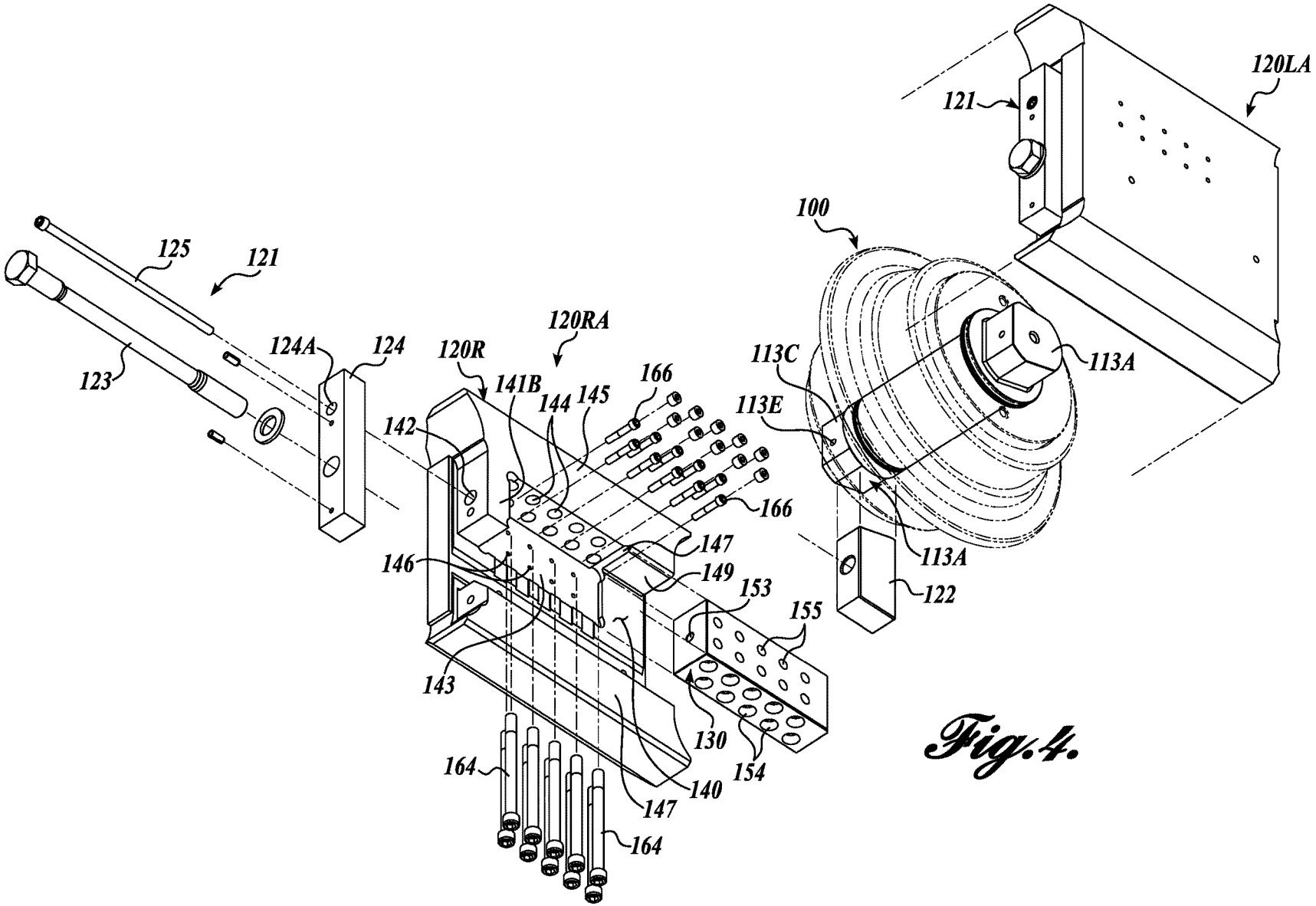
FIG. 4 is a partially exploded view of the assembly shown in FIG. 2.

Refer now also the exploded view shown in FIG. 4, the second seat surface 113C seats against the removable seat block 130. Optionally, a preload bolt 125 extends through an aperture 124A in the clamp block 124, then through an aperture 142 in the second leg 141B, and through a longitudinal aperture 153 in the removable seat block 130. The preload bolt 125 is configured to engage the threaded aperture 113E in the shaft end 113A. The preload bolt 125 is configured to pull the shaft end 113A to seat the second seat surface 113C against the removable seat block 130, which facilitates proper installation of the disc cutter assembly 100.

An important aspect of the housing mount assembly 120RA is the connection of the removable seat block 130 to the housing half 120R, which is configured such that forces received from the shaft 113 and transmitted from the removable seat block 130 to the housing half 120R are substantially transmitted to the housing half 120R in shear, as discussed below.

Refer still to FIG. 4 showing a perspective view of the assembly of FIG. 2, with the first housing mount assembly 120RA exploded and the disc cutter assembly 100 shown partially in phantom.

In this embodiment the main body portion 140 of the housing half 120R defines a recessed region 143 sized to receive the removable seat block 130, wherein the L-shaped first edge portion 145 are aligned with, or define, two sides of the recessed region 143. The recessed region 143 may receive the removable seat block 130 in an interference fit, for example, using a thermal or pressing process to insert the removable seat block 130 into the recessed region 143.

First threaded apertures 144 extend at least part way through the first edge portion 145 of the housing half 120R. A corresponding plurality of through apertures 154 aligned with the threaded apertures 144 extend through the removable seat block 130. First bolts 164 extend through the through apertures 154 in the removable seat block 130 and engage the threaded apertures 144 to tightly urge the removable seat block 130 against the first edge portion 145.

Second threaded apertures 146 extend at least part way through the main body portion 140 of the housing half 120R. A corresponding plurality of through apertures 155 aligned with the second plurality of threaded apertures 146 extend through the removable seat block 130, and are generally perpendicular to the first plurality of through apertures 154. Second bolts 166 extend through the second apertures 155 in the removable seat block 130 and engage the threaded apertures 146 to tightly urge the removable seat block 130 against the main body portion 140 of the housing half 120R. In the current embodiment ten first bolts 164 and ten second bolts 166 fix the removable seat block 130 to the housing half 120R. It will be appreciated that the plurality of bolts 164, 166 may be adjusted to press the removable mounting block 130 against the surfaces of the housing half 120R with a relatively uniform force. In other embodiments six or more first and second bolts may be used. Preloading the faces of the removable seat block 130 against corresponding faces of the housing halves 120L, 120R provides a construction wherein the violent tunnel boring forces transmitted to the seat blocks 130 through the shaft ends 113A are subsequently transmitted substantially in shear to the housing halves 120L, 120R, reducing the risk of damage to the housing halves 120L, 120R, and thereby improving the reliability of the TBM.

In the exemplary embodiment shown in FIGS. 2-5 the ends 113A of the cutter shaft 113 are preloaded to the removable seat block 130 with the preload bolts 125. The bolt 123 of the wedge lock assembly 121 is configured to adjustably pull the wedge member 122 in the axial direction of the bolt 123 such that the wedge member 122 engages surface 113D of the shaft end 113A, urging the shaft end 113A in the transverse direction to seat against the housing half 120R. It may be advantageous to tighten the bolts 123, 125 in a multistep installation procedure alternatingly torqueing the bolts 123, 125 sequentially to a plurality of intermediate torque values, prior to the final tightening, to securely seat the shaft 113 in both the axial and transverse directions.

Figure 5:
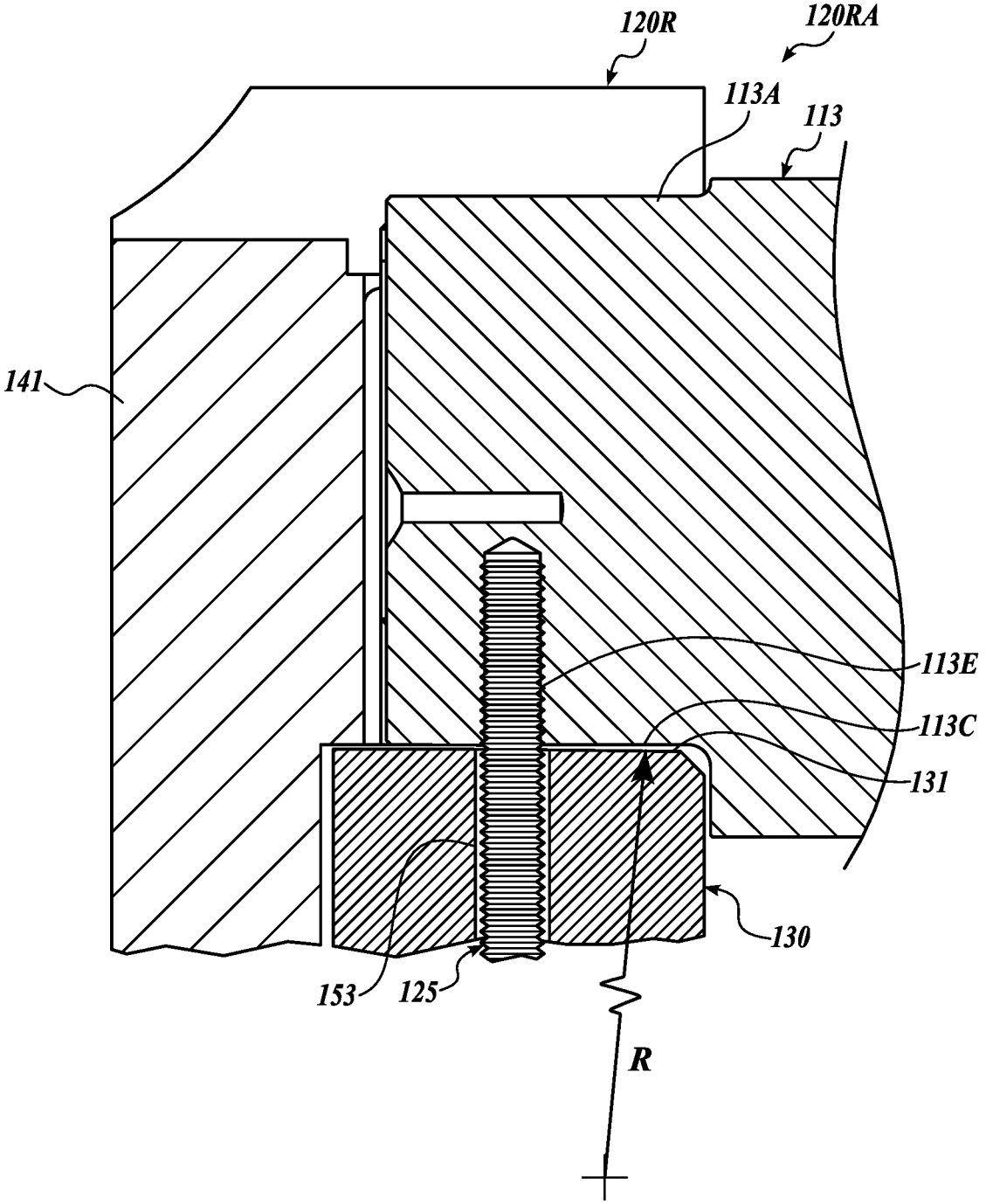
FIG. 5 is a detail sectional view through section 5-5 indicated in FIG. 3, and showing an end of the cutter wheel shaft abutting the removable seat block.

Refer now also to FIG. 5 which shows a detail sectional view of the first housing mount assembly 120RA showing a portion of the housing half 120R, and of the removable seat block 130 that engages the face 113C of the shaft 113. The bolt 125 extends through the removable seat block 130 and pulls the shaft end 113A into engagement with the removable seat block 130. In this embodiment the seating face 131 of the removable seat block 130 is convex in the transverse direction, for example, with a circular curvature having a relatively large radius R. The curved face 131 prevents or reduces edge-loading of the block 130 inside edges during cutter shaft 113 deflection under extreme loads. Although the current embodiment includes a radius R on the seating surface of the removable seat block 130, it is contemplated that the shaft end 113A may alternatively be formed with a contoured surface shape, to achieve the same advantage, or the removable block and shaft end may both be contoured, to achieve the same advantage. In particular, the convex surface engagement enables the line of contact between the shaft contacting surface 113C to move as the line contact moves toward the inside edge of the removable block 130 during shaft 113 deflection under extreme loads.

An advantage of the disclosed housing mount assemblies 120RA, 120LA is that the seat blocks 130 are field replaceable. If the removable seat blocks 130 become damaged or worn, the damaged blocks 130 may be replaced without requiring the housing halves 120L and/or 120R to be detached from the mounting plates (not shown). The removable seat block 130 reacts the loads substantially in shear. The modular design also allows the relatively small removable seat blocks 130, and in particular the seating surfaces of the seat blocks 130, to be produced with very high hardness properties. In a current embodiment the seat portion of the removable seat blocks 130 is case hardened to a Rockwell C hardness of Rc 58-60. This hardness is much harder and more abrasion resistant that any used in the industry.

While illustrative embodiments have been illustrated and described, it will be appreciated that various changes can be made therein without departing from the spirit and scope of the invention.

The embodiments of the invention in which an exclusive property or privilege is claimed are defined as follows:

1. A disc cutter and mounting assembly for a tunnel boring machine comprising:

a disc cutter assembly comprising a shaft having first and second end portions, and a cutter wheel rotatably disposed on the shaft, wherein the first and second end portions each include a first seat surface, a second seat surface, and a third seat surface; and first and second housing mount assemblies, each of the first and second housing mount assemblies configured to engage an associated one of the first and second end portions of the shaft and comprising:

a housing half comprising a body portion, a first edge portion extending away from the body portion, and a second edge portion extending away from the body portion, wherein the body portion, the first edge portion, and the second edge portion cooperatively define a mounting space between the first and second edge portions;

a removable seat block disposed in the mounting space and removably attached to the housing half such that a first face of the removable seat block is pressed against the first edge portion of the housing half, a second face of the removable seat block is pressed against the body portion of the housing half, and a seating face of the removable seat block is configured to engage the second seat surface of the associated end portion of the shaft; and a wedge lock assembly comprising a clamp block, a wedge member having a first face configured to slidably engage the housing half second edge portion and an opposite face configured to slidably engage the third seat surface of the associated end portion of the shaft, and an elongate connector adjustably connecting the clamp block to the wedge member and configured to controllably adjust a distance between the clamp block and the wedge member, whereby the wedge lock assembly is configured to clamp the associated end portion of the shaft between the wedge member and the first edge portion of the housing half.

2. The disc cutter and mounting assembly of claim 1, wherein the removable seat blocks are configured to be removable from the assembly without removing the associated housing half from the tunnel boring machine.

3. The disc cutter and mounting assembly of claim 1, wherein the removable seat blocks are configured to receive tunnel boring forces from the shaft, and to transmit the received forces to the associated housing half in shear.

4. The disc cutter and mounting assembly of claim 1, wherein the first face of the removable seat blocks are pressed against the first edge portion of the associated housing half with a first plurality of bolts comprising at least six bolts that extend through first apertures in the removable seat block and engage the first edge portion of the housing half.

5. The disc cutter and mounting assembly of claim 4, wherein the second face of the removable seat blocks are pressed against the body portion of the associated housing half with a second plurality of bolts comprising at least six bolts that extend through second apertures in the removable seat block and engage the body portion of the associated housing half.

6. The disc cutter and mounting assembly of claim 5, wherein the first plurality of bolts are oriented perpendicular to the second plurality of bolts.

7. The disc cutter and mounting assembly of claim 4, wherein each of the first and second housing mount assemblies further comprises a preload bolt that extends through a longitudinal aperture in the removable seat block and threadably engages the associated end portion of the shaft, wherein the preload bolt is configured to pull the associated end portion of the shaft against the removable seat block.

8. The disc cutter and mounting assembly of claim 1, wherein each of the removable seat blocks is disposed in a recess in the body portion of the associated housing half.

9. The disc cutter and mounting assembly of claim 8, wherein each of the removable seat blocks is in an interference fit with the recess in the body portion of the associated housing half.

10. The disc cutter and mounting assembly of claim 1, wherein for each of the first and second end portions of the shaft the first seat surface is configured to abut the first edge portion of the associated housing half.

11. The disc cutter and mounting assembly of claim 1, wherein the seating face of the removable seat blocks is case hardened to a Rockwell C hardness in the range of Rc 58 to Rc 60.

12. The disc cutter and mounting assembly of claim 1, wherein the seating face of the removable seat block is convex.

13. A housing mount assembly for mounting a disc cutter assembly to a tunnel boring machine, wherein the disc cutter assembly includes a shaft having first and second end portions, each end portion having a first seat surface, a second seat surface, and a third seat surface, the housing mount assembly comprising:

a housing half comprising a body portion, a first edge portion extending away from the body portion, and a second edge portion extending away from the body portion, wherein the body portion, the first edge portion, and the second edge portion cooperatively define a mounting space between the first and second edge portions;

a removable seat block disposed in the mounting space and removably attached to the housing half such that a first face of the removable seat block is pressed against the first edge portion of the housing half, a second face of the removable seat block is pressed against the body portion of the housing half, and a seating face of the removable seat block is configured to engage the second seat surface of an associated end portion of the shaft; and a wedge lock assembly comprising a clamp block, a wedge member having a first face configured to slidably engage the housing half second edge portion and an opposite face configured to slidably engage the third seat surface of the associated end portion of the shaft, and an elongate connector adjustably connecting the clamp block to the wedge member and configured to controllably adjust a distance between the clamp block and the wedge member, whereby the wedge lock assembly is configured to clamp the associated end portion of the shaft between the wedge member and the first edge portion of the housing half.

14. The housing mount assembly of claim 13, wherein the removable seat block is configured to be removable from the assembly without removing the associated housing half from the tunnel boring machine.

15. The housing mount assembly of claim 13, wherein the removable seat block is configured to receive tunnel boring forces from the shaft, and to transmit the received forces to the housing half in shear.

16. The housing mount assembly of claim 13, wherein the first face of the removable seat block is pressed against the first edge portion of the housing half with a first plurality of bolts comprising at least six bolts that extend through first apertures in the removable seat block and engage the first edge portion of the housing half.

17. The housing mount assembly of claim 16, wherein the second face of the removable seat block is pressed against the body portion of the housing half with a second plurality of bolts comprising at least six bolts that extend through second apertures in the removable seat block and engage the body portion of the housing half.

18. The housing mount assembly of claim 17, wherein the first plurality of bolts are oriented perpendicular to the second plurality of bolts.

19. The housing mount assembly of claim 16, further comprising a preload bolt that extends through a longitudinal aperture in the removable seat block and threadably engages the first end portion of the shaft, wherein the preload bolt is configured to press the end portion of the shaft against the removable seat block.

20. The housing mount assembly of claim 13, wherein the removable seat block is disposed in a recess in the body portion of the housing half.

21. The cutter assembly of claim 13, wherein a seat portion of the removable seat block is case hardened to a Rockwell C hardness in the range of Rc 58 to Rc 60.

* * * * *